US006382324B1

(12) United States Patent
Anyan

(10) Patent No.: US 6,382,324 B1
(45) Date of Patent: May 7, 2002

(54) ONE TRIP SEAL LATCH SYSTEM

(75) Inventor: Steven L. Anyan, Sugar Land, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/597,612

(22) Filed: Jun. 20, 2000

(51) Int. Cl.[7] ..... E21B 17/02; E21B 23/00

(52) U.S. Cl. ..... 166/382; 166/115; 166/237; 166/242.6

(58) Field of Search ..... 166/237, 242.6, 166/378, 380, 387, 382, 206, 240, 115, 208

(56) References Cited

U.S. PATENT DOCUMENTS 4,248,307 A * 2/1981 Silberman et al. ..... 166/189
4,399,873 A 8/1983 Lindsey, Jr.
4,449,736 A * 5/1984 Blackwell ..... 285/3
4,508,167 A * 4/1985 Weinberg et al. ..... 166/120
4,513,817 A * 4/1985 Weinberg ..... 166/138
4,601,343 A * 7/1986 Lindsey, Jr. et al. ..... 166/382
4,612,985 A 9/1986 Rubbo et al.
4,655,290 A 4/1987 Smith, Jr.
4,928,768 A 5/1990 Peterson
4,942,925 A * 7/1990 Themig ..... 166/382
5,662,341 A * 9/1997 Ezell et al. ..... 277/27
6,065,536 A * 5/2000 Gudmestad et al. ..... 166/208

* cited by examiner

*Primary Examiner*—David Bagnell
*Assistant Examiner*—Jennifer H Gay
(74) *Attorney, Agent, or Firm*—Fletcher, Yoder & Van Someren

(57) ABSTRACT

A system for permitting deployment of a polished bore receptacle, seal stack and production tubing in a single downhole trip into a wellbore. The system includes a polished bore receptacle, production tubing, a seal stack disposed about the production tubing, and a one trip seal latch that couples the production tubing to the polished bore receptacle. The seal latch includes an outer latch housing and an inner latch housing. The outer housing and inner housing are connected by a releasable coupling device. Thus, the polished bore receptacle can be moved downhole for latching to a packer without insertion of the seal stack into the interior of the polished bore receptacle. Upon latching of the polished bore receptacle to the packer, the coupler may be selectively released to permit insertion of the seal stack into the polished bore receptacle.

25 Claims, 6 Drawing Sheets

ONE TRIP SEAL LATCH SYSTEM

FIELD OF THE INVENTION

The present invention relates generally to the production of fluid from a wellbore, and particularly to a system that permits the deployment of a polished bore receptacle (PBR) and the corresponding seal stack with a single trip downhole.

BACKGROUND OF THE INVENTION

A variety of equipment and devices are used in downhole, wellbore environments. In certain applications, production tubing is coupled to a packer via a polished bore receptacle that receives a seal stack disposed at the downhole end of the production tubing.

For example, a packer may be disposed within a wellbore for the production of a desired fluid, such as petroleum. Appropriate tubing extends downwardly from the packer to a gravel pack through which the production fluid flows. Typically, an inlet covered by sand screens permits the flow of production fluid into the tubing while preventing the inflow of sand and other undesirable particulate matter.

The production fluid flows upwardly through the tubing and packer into the production tubing which conducts the production fluid to a surface location or other collection point. The production tubing may have substantial length and is subject to expansion and contraction while in the wellbore. Thus, it is desirable to have a coupling between the packer and the production tubing that accommodates this movement. Often, a polished bore receptacle is latched into an upper end of the packer, and the production tubing is stung into the polished bore receptacle with an appropriate seal stack to prevent leakage between the interior of the PBR and the production tubing. A standard seal stack includes a plurality of annular spaced seals that fit within the interior of the PBR.

Conventionally, downhole deployment of the PBR and the production tubing with associated seal stack required two trips downhole. The polished bore receptacle was initially deployed downhole and latched to the packer. The seal stack and production tubing were then deployed downhole and coupled to the polished bore receptacle in a second operation, i.e. trip downhole. The need for a second trip downhole added substantial time and expense to the overall deployment operation.

Attempts have been made to deploy the PBR and seal stack in a single trip by precoupling the seal stack within the PBR. The assembled unit can then be moved downhole and latched to the packer. However, because air is trapped between the seals of the seal stack at a relatively low surface pressure, e.g. atmospheric pressure, a substantial pressure differential results once the PBR and seal stack are moved to the downhole, high pressure environment. The comparatively high external pressure tends to squeeze the PBR, thereby reducing the internal diameter of the PBR and restricting motion of the seal stack within the PBR.

It would be advantageous to have a system and method that permitted the deployment of a polished bore receptacle, seal stack and production tubing in a single trip downhole while allowing for pressure equalization between the seals of the seal stack.

SUMMARY OF THE INVENTION

The present invention features a latch for connecting a deployment tubing, having a seal stack, to a polished bore receptacle such that the deployment tubing and the polished bore receptacle may be deployed downhole simultaneously. The latch includes an outer latch housing having an interior passage of sufficient size to permit passage of a seal stack therethrough. The outer latch housing also includes a PBR connector end designed to engage the polished bore receptacle. The latch further includes an inner latch housing having a tubing connector end designed to engage the deployment tubing. Additionally, a housing coupler is connected between the outer latch housing and the inner latch housing. The housing coupler may be selectively disconnected to permit passage of the inner latch housing and the seal stack through the interior passage.

According to another aspect of the present invention, a system and method are provided for deploying a polished bore receptacle at a packer located downhole in a wellbore. The system includes a deployment tubing and a seal disposed about the deployment tubing. The system further includes a polished bore receptacle and a releasable latch. The releasable latch is coupled to the deployment tubing and to the polished bore receptacle. The design of the releasable latch permits the seal to be held outside of the polished bore receptacle during deployment. However, upon attachment of the polished bore receptacle to the packer, the releasable latch may be activated to permit insertion of the seal into the polished bore receptacle.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

The present invention permits the deployment of a polished bore receptacle, tubing and seal stack with a single trip into a wellbore. To accomplish the single trip deployment, the tubing, e.g. production tubing, and seal stack are connected to the polished bore receptacle by a seal latch, as described below. Use of the seal latch is described herein in combination with a typical production system to facilitate explanation of the use and function of the seal latch system, but this description should not be construed as limiting. The seal latch system can be used in a variety of environments and applications.

Figure 1:
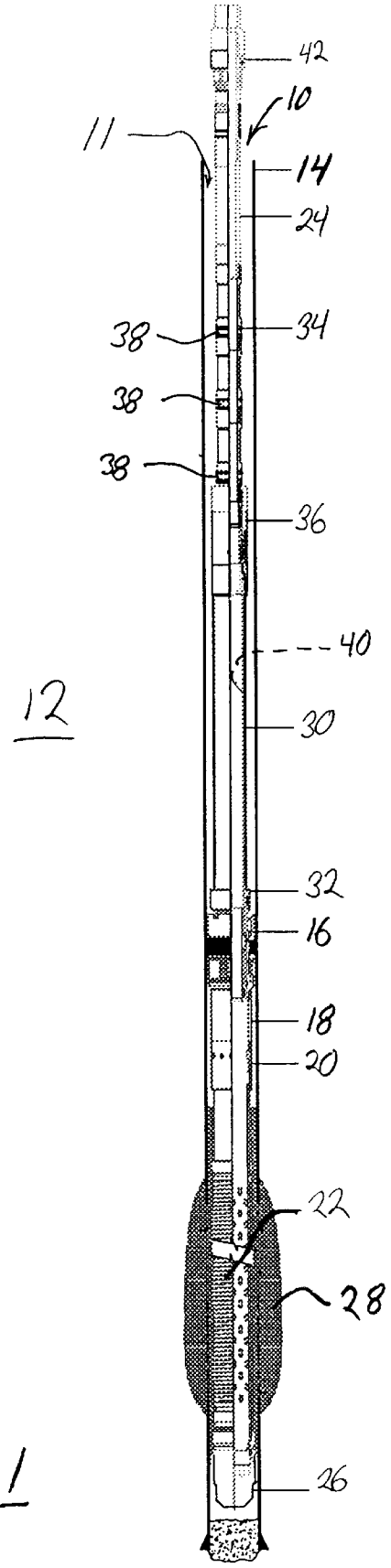
FIG. 1 is a front elevational view of a system positioned in a wellbore, according to a preferred embodiment of the present invention.

Referring generally to FIG. 1, an exemplary application of a production system 10 is illustrated. Typically, a wellbore 11 is formed in a production formation 12 and lined with a wellbore casing 14. Within wellbore casing 14, a packer 16, such as a Quantum Gravel Pack Packer, is deployed at a desired location within wellbore 11. A packer extension 18 extends downwardly from packer 16 and may cooperate with a circulating housing 20 having a port closure sleeve, as known to those of ordinary skill in the art.

Production fluids, such as petroleum, enter wellbore casing 14 through perforations in casing 14 and often flow through a production screen 22. Production screen 22 tends to prevent sediment and particulate matter from settling into system 10, while allowing the inflow of production fluid. As the production fluid flows through production screen 22 it moves upwardly through packer extension 18 and packer 16 so that it may ultimately be produced through a tubing 24, e.g. production tubing, to a storage location at, for example, the earth's surface.

The system also may include a bull plug 26 generally disposed below production screen 22. A gravel pack 28 also is disposed around production screen 22 proximate bull plug 26. Gravel pack 28 includes aggregate used to fill a region surrounding production screen 22.

System 10 further includes a polished bore receptacle 30 coupled to packer 16 by a latch 32, such as an anchor latch. Also, polished bore receptacle 30 is connected to tubing 24 and a seal stack 34 by a one-trip seal latch 36.

Seal stack 34 includes a plurality of seals 38, e.g. five sets of seals 38 that are spaced along tubing 24, but designed for insertion into a polished internal bore 40 of polished bore receptacle 30. Typically, seals 38 are annular seals disposed about tubing 24 that sometimes have a chevron shape. Furthermore, a snap latch 42 is disposed about tubing 24 at a location above seal stack 34 to provide an indication of proper insertion of seal stack 34 into polished bore receptacle 30.

Polished bore receptacle 30 is used in combination with seal stack 34 to accommodate expansion and contraction of tubing 24, as well as other linear movements of tubing 24, without disturbing the operation of system 10. Thus, prior to production of fluids through system 10, seal stack 34 is moved from the position illustrated in FIG. 1 to a position within the polished internal bore 40 of polished bore receptacle 30. The desired position within polished bore receptacle 30 allows for both downward and upward movement of the seal stack.

Insertion of seal stack 34 into polished bore receptacle 30 prior to deployment within wellbore 11 leads to detrimental pressure differentials acting on the polished bore receptacle. Therefore, seal latch 36 is designed to permit simultaneous deployment of polished bore receptacle 30, seal stack 34 and tubing 24 while avoiding insertion of seal stack 34 into polished bore receptacle 30 until the system 10 is fully deployed within wellbore 11.

Figure 2:
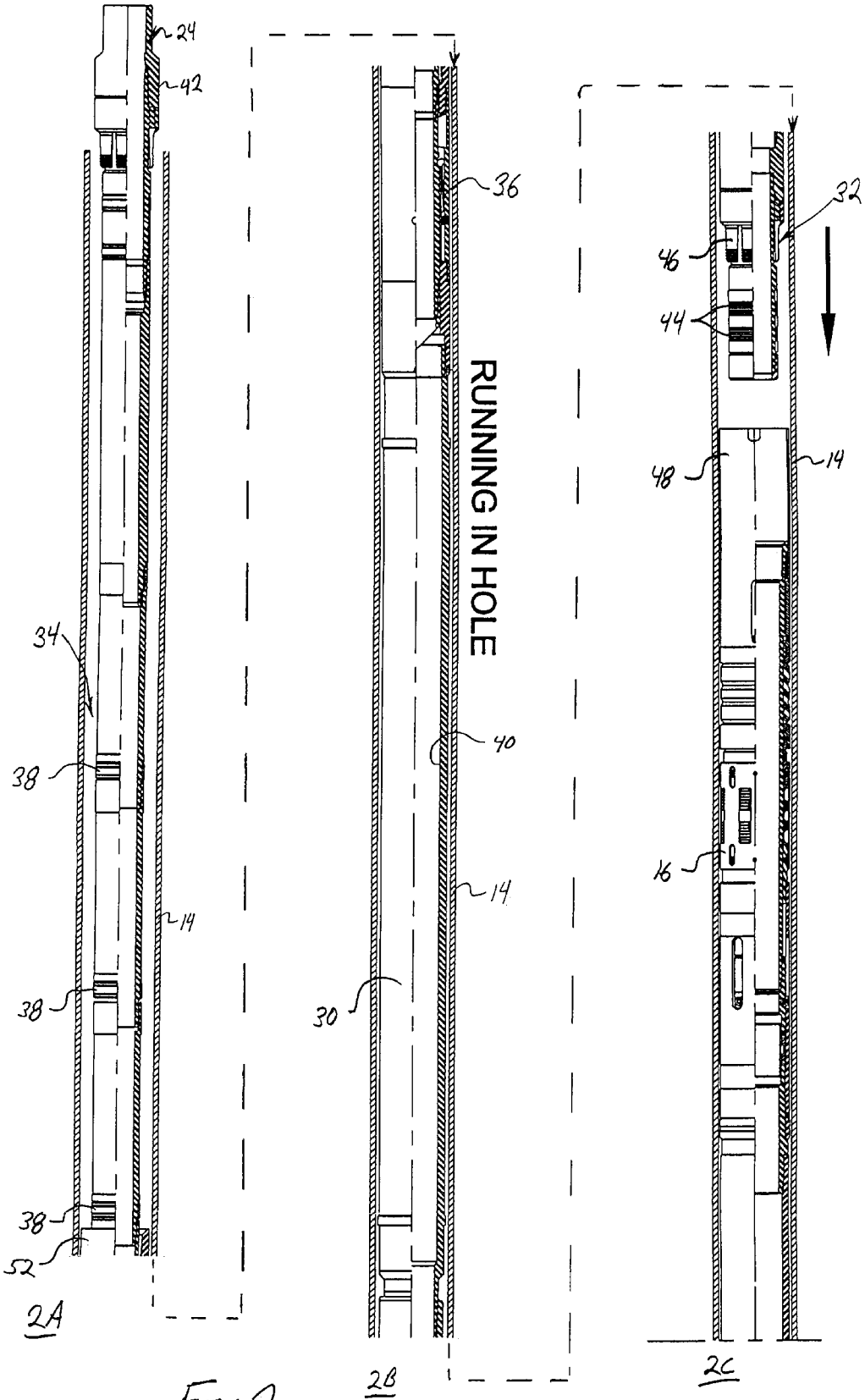
FIG. 2 is a front elevational view of the system of FIG. 1 during movement of the polished bore receptacle downhole for latching to the packer.
Figure 3:
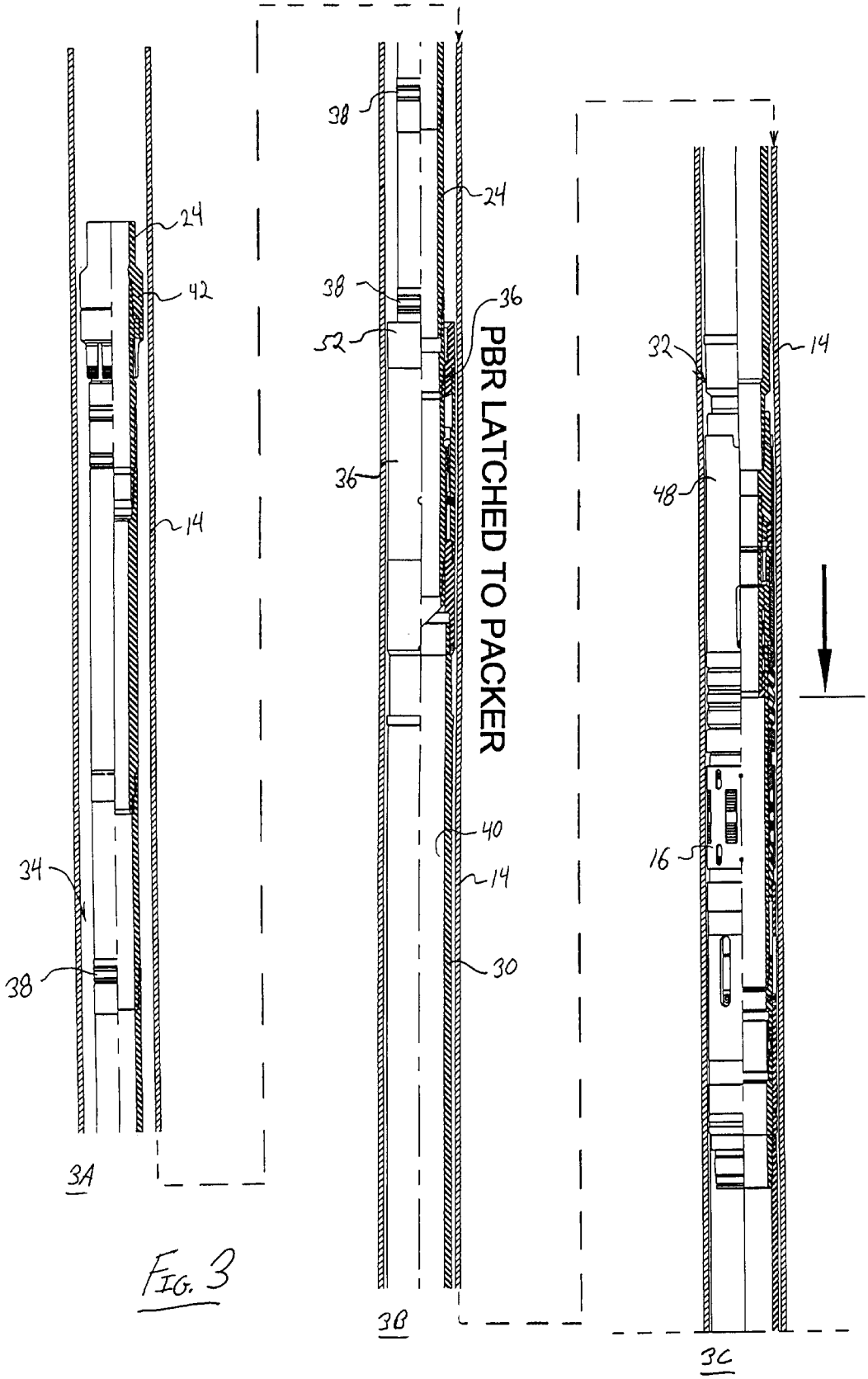
FIG. 3 is a front elevational view of the system of FIG. 1 in which the polished bore receptacle is latched to the packer.
Figure 4:
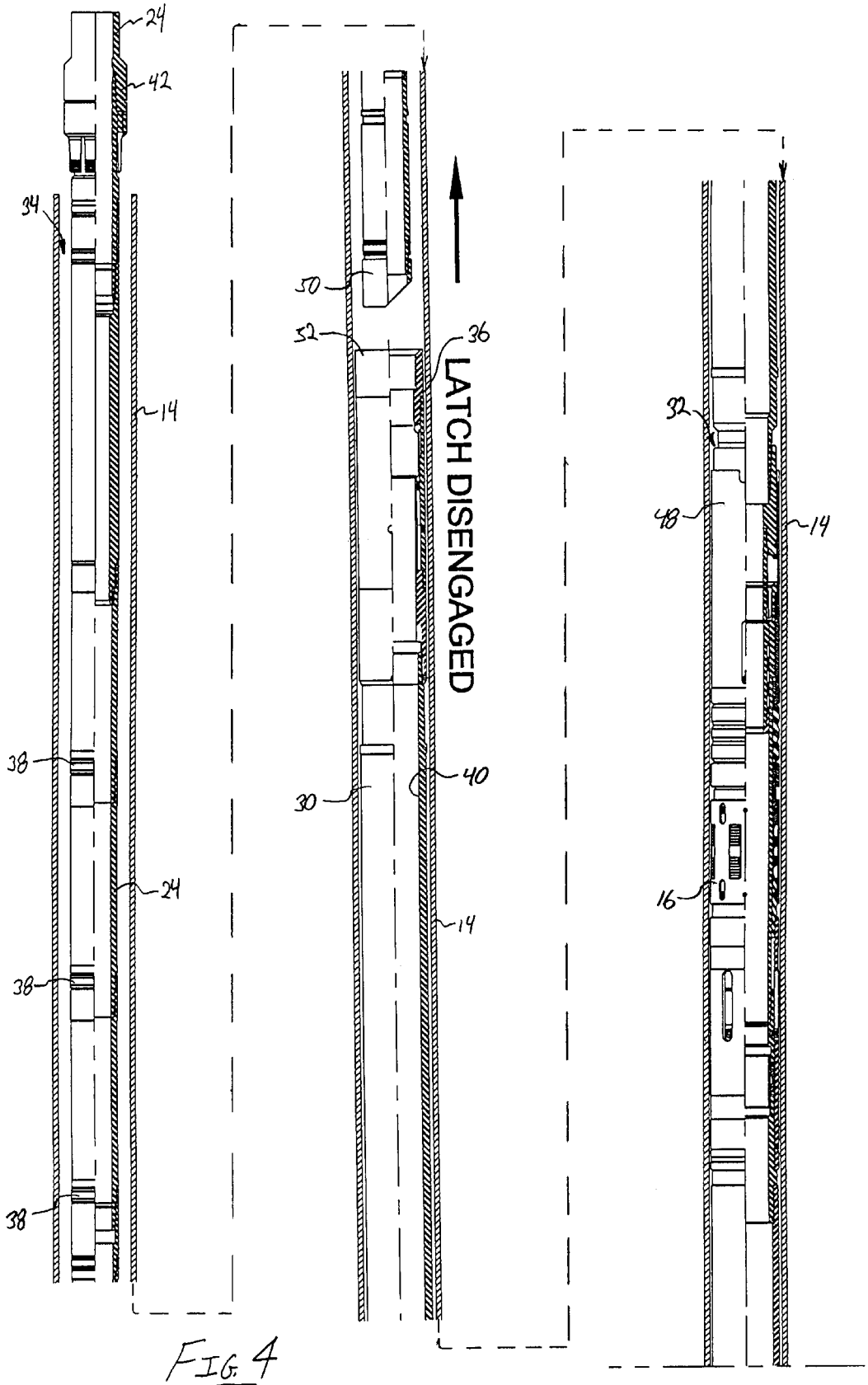
FIG. 4 is a front elevational view of the system of the system of FIG. 3 in which the seal stack and production tubing have been unlatched from the polished bore receptacle.

Referring generally to FIGS. 2 through 5, the installation of polished bore receptacle 30, seal stack 34 and tubing 24 in a single, downhole trip is illustrated. It should be noted that each of FIGS. 2, 3 and 4 is illustrated in three sections, e.g. 2A, 2B and 2C, because of the length of system 10. Each section of a given Figure continues into the subsequent section as indicated by the dashed lines.

In FIG. 2, tubing 24 and seal stack 34 are connected to polished bore receptacle 30 by seal latch 36. This entire assembly is moved downhole towards packer 16 until latch 32 is in proximity to packer 16. Preferably, latch 32 is an anchor latch having one or more seals 44 and a latching mechanism 46 designed for engagement with an upper receptacle 48 of packer 16. The downward movement is continued until latch 32 securely engages receptacle 48 of packer 16, as illustrated in FIG. 3.

After securing polished bore receptacle 30 to packer 16, tubing 24, and seal stack 34 are lifted with sufficient tensile force to release seal latch 36, as illustrated in FIG. 4. The lifting of tubing 24 is accomplished by conventional deployment equipment located, for example, at the surface of the earth. Because polished bore receptacle 30 has been securely latched to packer 16, the tensile force does not lift the polished bore receptacle but rather releases seal latch 36 such that seal stack 34 may be drawn upwardly. Typically, a guide shoe 50, e.g. mule shoe, is attached below seal stack 34 to guide seal stack 34 back into polished bore receptacle 30 if pulled free during the lifting motion. For some applications, it may be desirable to lift seal stack 34 and guide shoe 50 above an upper end 52 of polished bore receptacle 30 to ensure release of seal latch 36.

Figure 5:
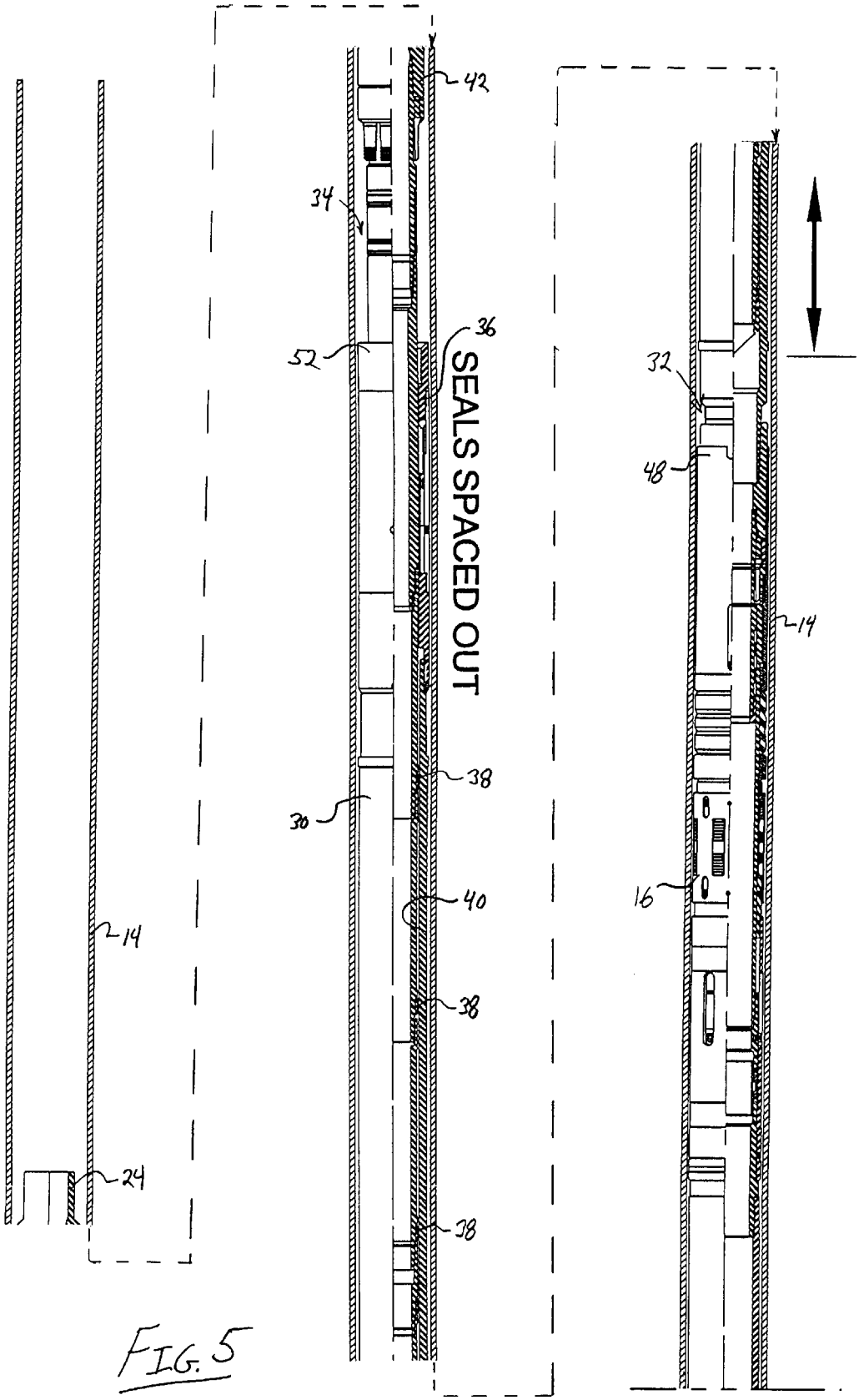
FIG. 5 is a front elevational view of the system illustrated in FIG. 1 in which the seal stack has been inserted into the polished bore receptacle.

Subsequent to release of seal latch 36, tubing 24 and seal stack 34 are moved downwardly into the interior 40 of polished bore receptacle 30, as illustrated in FIG. 5. Preferably, seal stack 34 is inserted into polished bore receptacle 30 until snap latch 42 engages upper end 52 of polished bore receptacle 30. Typically, the snap latch 42 is designed to release upon application of a specific tensile force. Release of snap latch 42 from upper end 52 under the specific tensile force demonstrates successful deployment of seal stack 34 into polished bore receptacle 30. After connecting snap latch 42 with upper end 52 (one or more times) to ensure that seal stack 34 is appropriately positioned within the interior of polished bore receptacle 30, snap latch 42 is lifted from and maintained above upper end 52. Once properly positioned, system 10 may be operated for the production of fluid.

Figure 6:
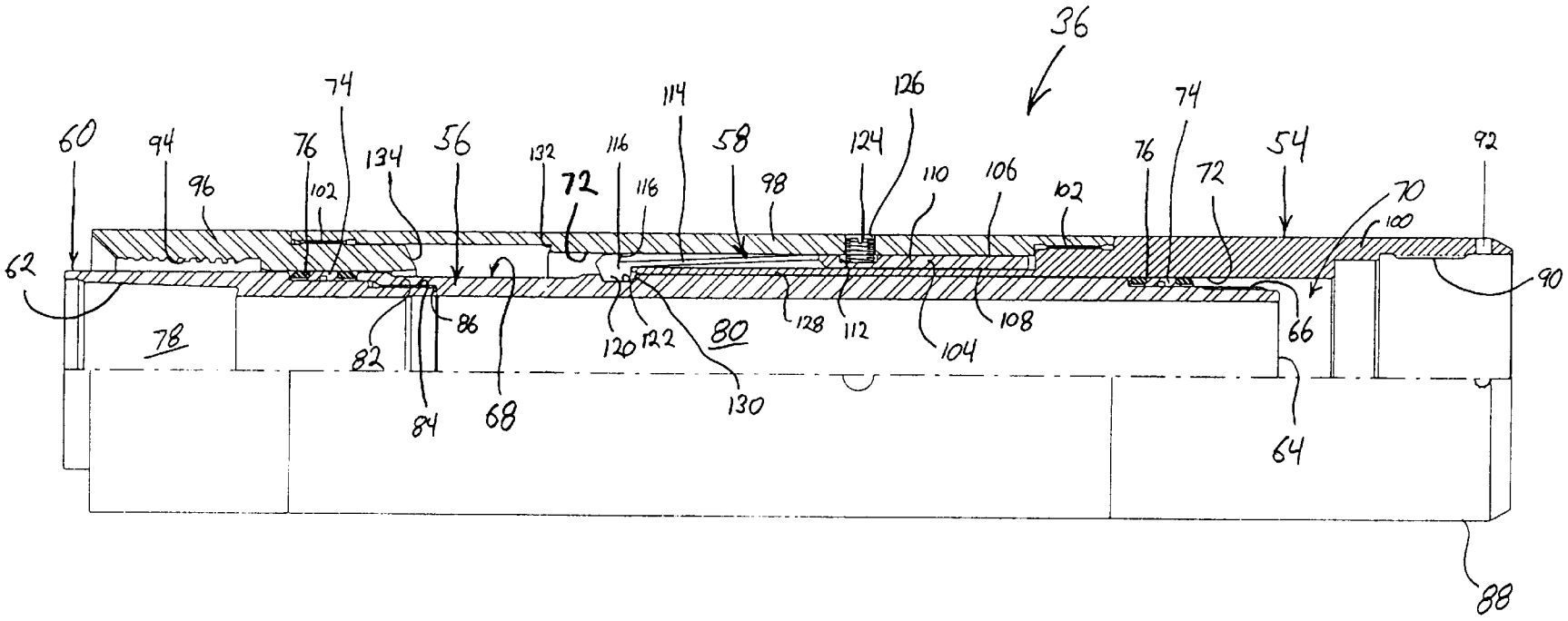
FIG. 6 is a partial cross-sectional view of the "one-trip" seal latch that permits deployment of the polished bore receptacle, seal stack and tubing in a single trip downhole, according to a preferred embodiment of the present invention.

An exemplary embodiment of seal latch 36 that permits the one-trip deployment of a polished bore receptacle, seal stack and tubing is illustrated in FIG. 6. Seal latch 36 generally includes an outer housing 54 and an inner housing 56. Outer housing 54 and inner housing 56 are connected by a releasable housing coupler 58.

Inner housing 56 includes a tubing connector end 60 designed for connection to tubing 24 at a location beneath seal stack 34. For example, tubing connector end 60 may include an internally threaded region 62 that may be threadably engaged with a corresponding externally threaded region at the lower connecting end of tubing 24.

Generally opposite tubing connector end 60, inner housing 56 includes an attachment end 64 designed for attachment to the mule shoe 50. Attachment end 64 may include, for example, an external threaded region 66 designed for threaded engagement with corresponding internal threads on mule shoe 50.

Inner housing 56 further includes an exterior surface 68 sized to fit within a hollow interior 70 formed by an interior surface 72 of outer housing 54. Exterior surface 68 may include a pair of annular recessed areas 74 for receiving debris barriers 76. Debris barriers 76 are designed to prevent the flow of particulates and other debris between outer housing 54 and inner housing 56, and may be formed as a rubber on metal bonded seal. However, typically it is not necessary for the debris barriers to form a fluid-tight seal. Debris barriers 76 preferably also act to centralize inner housing 56 within outer housing 54.

In the illustrated embodiment, inner housing 56 is formed by the combination of an upper section 78 and a lower section 80. Upper section 78 and lower section 80 are joined at a connection region 82 by, for example, threaded engagement. In the embodiment shown, upper section 78 includes external connector threads 84 designed for threaded engagement with internal connector threads 86 of lower section 80. It should be noted that inner housing 56 may be formed of a single section or multiple sections joined in a variety of ways.

Outer housing 54 includes a PBR connector end 88 designed to engage polished bore receptacle 30. One exemplary method of joining PBR connector end 88 and polished bore receptacle 30 is by threaded engagement. For example, PBR connector end 88 may have an internally threaded region 90 designed to threadably receive corresponding external threads formed on the upper end of polished bore receptacle 30. PBR connector end 88 also may include a plurality of threaded radial openings 92 for receiving set screws that are tightened against the exterior surface of polished bore receptacle 30. Additionally, PBR connector end 88 is designed to orient polished bore receptacle 30 such that inner housing 56 and seal stack 34 may freely pass through interior passage 70 and into the interior 40 of polished bore receptacle 30.

At an end opposite PBR connector end 88, outer housing 54 includes an optional connector 94. Connector 94 typically is designed for use in latching other devices or to permit attachment of a fishing tool.

In the exemplary embodiment illustrated, outer housing 54 is formed by joining three sections, an upper section 96, a middle section 98 and a lower section 100. However, outer housing potentially may be formed by a single housing or by multiple housings joined according to a variety of methods. In the exemplary embodiment, the three sections 96, 98, 100 are joined at a pair of threaded regions 102.

Housing coupler 58 secures outer housing 54 to inner housing 56 during deployment of polished bore receptacle 30, seal stack 34 and tubing 24. However, upon latching of polished bore receptacle 30 to packer 16, housing coupler 58 permits the selective decoupling or disconnection of inner housing 56 from outer housing 54 such that inner housing 56 and seal stack 34 may be inserted into polished bore receptacle 30. Potentially, a variety of housing coupler designs may be utilized, but a preferred, exemplary design has been illustrated.

In the illustrated embodiment, housing coupler 58 includes a coupling member 104, such as a collet. Coupling member 104 is an annular member having an exterior surface 106 designed to fit within the interior surface 72 of outer housing 54. Coupling member 104 also includes an interior surface 108 sized to fit about the exterior of inner housing 56. Furthermore, coupling member 104 includes a base portion 110 having an external recess, such as an annular groove 112. At least one and preferably a plurality of fingers 114, e.g. eight fingers, extend generally axially from base portion 110. Each finger 114 includes an expanded head 116 having a hook portion 118 extending radially outwardly and a retention portion 120 extending radially inward.

While outer housing 54 is joined to inner housing 56, retention portion 120 is held within a retention recess, e.g. a groove 122, formed in the external surface 68 of inner housing 56. The abutment of a radially exterior surface of hook portion 118 against interior surface 72 of outer housing 54 secures retention portion 120 within groove 122. Simultaneously, one or more shear screws 124 are threadably engaged with corresponding radial openings 126 formed through outer housing 54. The shear screws 124 are threaded into engagement with the annular groove 112 formed in base portion 110 of coupling member 104. The shear screws 124 cooperate with retention portion 120 to prevent linear movement of inner housing 56 with respect to outer housing 54 during deployment of polished bore receptacle 30 and seal stack 34 to packer 16.

Due to some compressive forces exerted during latching of polished bore receptacle 30 to packer 16, it may be desirable to protect fingers 114 against such forces. In the illustrated embodiment, lower section 100 of outer housing 54 includes a slender support member 128 that extends between interior surface 108 of coupling member 104 and exterior surface 68 of inner housing 56 into abutting engagement with retention portions 120 of fingers 114. The support member 128 absorbs compressive forces that could otherwise be applied against fingers 114.

Following successful latching of polished bore receptacle 30 to packer 16, a sufficient tensile force is applied to tubing 24 and inner housing 56 to break or shear the shear screws 124. Specifically, a lower abutment surface 130, e.g. the lower wall forming retention groove 122, engages retention portion 120 and lifts coupling member 104 until shear screws 124 are sheared. As coupling member 104 is lifted, hook portion 118 moves past a hook retainer 132 formed in interior surface 72 of outer housing 54. Fingers 114 spring radially outward such that hook portion 118 engages hook retainer 132 when inner housing 56 and seal stack 34 are inserted into polished bore receptacle 30. To ensure that fingers 114 flex outwardly, upper section 96 of outer housing 54 includes a sloped abutment 134 designed to engage retention portion 120 and force fingers 114 in a radially outward direction. With inner housing 56 separated from outer housing 54 and coupling member 104 retained by hook retainer 132, inner housing 56 and seal stack 34 may be inserted into polished bore receptacle without interference.

It will be understood that the foregoing description is of preferred exemplary embodiments of this invention, and that the invention is not limited to the specific forms shown. For example, the present system may be utilized in a variety of environments and applications; the design of the one trip seal latch housings and coupling member may be altered to accommodate the specific environment or application; and the methods of attaching the seal latch to both the tubing, e.g. production tubing, and the polished bore receptacle may be changed. These and other modifications may be made in the design and arrangement of the elements without departing from the scope of the invention as expressed in the appended claims.

What is claimed is:

1. A latch for connecting a deployment tubing, having a seal stack, to a polished bore receptacle such that the deployment tubing and the polished bore receptacle may be deployed downhole simultaneously, comprising:

an outer latch housing having: an interior passage of sufficient size to permit passage of the seal stack therethrough; and a PBR connector end designed to engage the polished bore receptacle;

an inner latch housing having a tubing connector end designed to engage the deployment tubing; and a housing coupler connected between the outer latch housing and the inner latch housing, wherein the housing coupler may be selectively disconnected to permit passage of the inner latch housing and the seal stack through the interior passage.

2. The latch as recited in claim 1, wherein the housing coupler comprises a coupling member and a shear screw.

3. The latch as recited in claim 2, wherein the coupling member includes: a base having a recessed region to receive the shear screw; and a flexible finger having an enlarged retention end.

4. The latch as recited in claim 3, wherein the inner latch housing includes a recess sized to receive the enlarged retention end.

5. The latch as recited in claim 4, wherein the enlarged retention end is held in the recess by an interior surface of the outer latch housing until the housing coupler is selectively disconnected.

6. The latch as recited in claim 5, wherein the outer latch housing includes a radial opening sized to receive the shear screw therethrough for insertion into the recessed region of the base of the coupling member.

7. The latch as recited in claim 6, wherein the flexible finger is biased radially outwardly towards the interior surface.

8. The latch as recited in claim 7, wherein the interior surface includes a relief area that permits the flexible finger to move out of the recess when the inner latch housing is moved a sufficient longitudinal distance with respect to the outer latch housing.

9. The latch as recited in claim 8, wherein the outer latch housing includes a catch to retain the flexible finger in the relief area.

10. The latch as recited in claim 9, wherein the-outer latch housing includes a sloped abutment positioned to force the flexible finger in a radially outward direction when the inner latch housing is moved a sufficient longitudinal distance with respect to the outer latch housing.

11. The latch as recited in claim 9, further comprising a debris barrier disposed between the inner latch housing and the outer latch housing.

12. The latch as recited in claim 2, wherein the coupling member comprises a base and a plurality of flexible fingers.

13. A system for deploying a polished bore receptacle downhole in a wellbore, comprising:

a deployment tubing;

a seal disposed about the deployment tubing;

a polished bore receptacle; and a releasable latch coupled to the deployment tubing and to the polished bore receptacle to maintain the seal external of the polished bore receptacle during deployment, wherein upon attachment of the polished bore receptacle to the packer, the releasable latch may be released to permit insertion of the seal into the polished bore receptacle.

14. The system as recited in claim 13, wherein the deployment tubing comprises production tubing.

15. The system as recited in claim 13, wherein the seal comprises a seal stack having a plurality of spaced, annular seals disposed about the deployment tubing.

16. The system as recited in claim 15, wherein the releasable latch comprises an outer housing, an inner housing and at least one shear screw to hold the outer housing in a desired position relative to the inner housing prior to insertion of the seal stack into the polished bore receptacle.

17. The system as recited in claim 16, wherein the releasable latch further comprises a retainer, the retainer including: a base having a recessed region to receive the shear screw; and a flexible finger having an enlarged retention end.

18. The system as recited in claim 17, wherein the inner housing includes a recess sized to receive the enlarged retention end.

19. The system as recited in claim 18, wherein the enlarged retention end is held in the recess by an interior surface of the outer housing until the housing coupler is selectively disconnected.

20. The system as recited in claim 19, wherein the interior surface includes a relief area that permits the flexible finger to move out of the recess when the inner latch housing is moved a sufficient longitudinal distance with respect to the outer latch housing.

21. A method for deploying a tubing string and a polished bore receptacle with a single trip into a wellbore, comprising:

deploying a tubing, a seal stack and a polished bore receptacle simultaneously into the wellbore;

maintaining the seal stack at a position external to the polished bore receptacle; and inserting the seal stack into the polished bore receptacle after the polished bore receptacle is moved to a desired downhole location.

22. The method as recited in claim 21, further comprising latching the polished bore receptacle to a packer located at the desired downhole location.

23. The method as recited in claim 22, further comprising connecting the tubing to the polished bore receptacle by a releasable latch.

24. The method as recited in claim 23, further comprising releasing the releasable latch by applying a tensile force to the tubing after latching the polished bore receptacle to the packer.

25. The method as recited in claim 24, wherein releasing includes shearing a shear screw upon application of the tensile force.

* * * * *